US008585176B2

(12) United States Patent
Iwasa et al.

(10) Patent No.: US 8,585,176 B2
(45) Date of Patent: Nov. 19, 2013

(54) INKJET PRINTING APPARATUS

(75) Inventors: Hiroshi Iwasa, Kyoto (JP); Hiroyuki Fuchioka, Kyoto (JP); Takeshi Katayama, Kyoto (JP); Ryoichi Naoe, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 4 days.

(21) Appl. No.: 13/305,375

(22) Filed: Nov. 28, 2011

(65) Prior Publication Data

US 2012/0194607 A1 Aug. 2, 2012

(30) Foreign Application Priority Data

Jan. 31, 2011 (JP) ..... 2011-017490
Jan. 31, 2011 (JP) ..... 2011-017506
Jan. 31, 2011 (JP) ..... 2011-017507

(51) Int. Cl.
*B41J 2/165* (2006.01)

(52) U.S. Cl.
USPC ..... 347/32

(58) Field of Classification Search
None
See application file for complete search history.

(56) References Cited

U.S. PATENT DOCUMENTS 6,578,945 B2 * 6/2003 Hashi et al. ..... 347/22
2008/0055358 A1 3/2008 Jung et al.
2008/0079773 A1 * 4/2008 Sakaida ..... 347/36
2009/0051731 A1 2/2009 Miyazawa
2010/0259580 A1 * 10/2010 Tsuji ..... 347/33
2011/0242195 A1 10/2011 Sugimoto
2011/0267400 A1 11/2011 Sakano

FOREIGN PATENT DOCUMENTS

EP 2 371 552 A1 10/2011
EP 2 383 120 A1 11/2011
JP 2001-018406 A 1/2001
JP 2004-358946 A 12/2004
JP 2008-055891 A 3/2008

OTHER PUBLICATIONS

Extended European Search Report issued in European Patent Application No. 11008931.5, dated Jan. 23, 2012.

* cited by examiner

*Primary Examiner* — Matthew Luu
*Assistant Examiner* — Alejandro Valencia
(74) *Attorney, Agent, or Firm* — McDermott Will & Emery LLP

(57) ABSTRACT

An inkjet printing apparatus 100 includes an inkjet head holder 11 holding inkjet heads 2, and a pair of head cap holders 12 and 13 holding head caps 3. When the inkjet head holder 11 is in a raised position, the head cap holders 12 and 13 are arranged as horizontally juxtaposed in a capping position, where the respective inkjet heads 2 and the respective head caps 3 are opposed to each other, below the inkjet head holder 11. When the inkjet head holder 11 is in a lowered position, the head cap holders 12 and 13 are arranged as vertically superposed in a withdrawn position laterally of a vertical movement area of the inkjet head holder 11.

8 Claims, 20 Drawing Sheets

INKJET PRINTING APPARATUS

BACKGROUND OF THE INVENTION

1. Field of the Invention

This invention relates to an inkjet printing apparatus for performing printing by moving a printing medium relative to inkjet heads.

2. Description of the Related Art

What is called a one-pass inkjet printing apparatus is known as an inkjet printing apparatus for outputting a large number of prints at high speed. This printing apparatus includes a print head having a plurality of inkjet heads to secure a discharge range substantially corresponding to a width in a primary scanning direction perpendicular to a transport direction of a recording medium (secondary scanning direction), and carries out recording by discharging ink as necessary to the recording medium transported.

In such an inkjet printing apparatus, head caps are used for the purpose of preventing drying of the inkjet heads. In order to prevent drying and contamination of areas adjacent ink discharge portions of the inkjet heads, these head caps cap (or cover) the areas adjacent the ink discharge portions of the inkjet heads during a printing standby time.

At a time of printing, such head caps need to be moved to a withdrawn position not to interfere with the printing. Japanese Unexamined Patent Publication No. 2008-55891 discloses an image forming apparatus having a cap member for enclosing a print head, in which the cap member is moved to a withdrawn position by means of a pivotable holding lever.

Where a construction as described in the above Japanese publication is employed to move head caps, as they are, laterally of the inkjet heads by using the holding lever, a large space is required to secure a moving area and a withdrawn area for the head caps. This gives rise to a problem of requiring a large space occupied by the entire inkjet printing apparatus. Particularly where, in order to perform efficient printing, a plurality of inkjet head rows, each row including a plurality of inkjet heads arranged in the primary scanning direction, are arranged in the transport direction of printing paper (secondary scanning direction), a head cap holder supporting the head caps will have a large area, thereby requiring a further enlarged space.

In such an inkjet printing apparatus, ink mist produced by ink scattering at a time of discharge, and paper powder produced from printing paper which is a recording medium, could adhere to ink discharge nozzle forming surfaces of the inkjet heads, thereby causing a defective ink discharge from the ink discharge nozzles. In order to maintain printing quality, therefore, such an inkjet printing apparatus includes a mechanism for cleaning the inkjet heads when necessary.

Japanese Unexamined Patent Publication No. 2001-18406 discloses an inkjet printing apparatus including a wiper carrier reciprocable in the primary scanning direction of a nozzle head having numerous inkjet nozzles aligned in the primary scanning direction. This inkjet printing apparatus, after forcibly discharging ink from the nozzle heads positioned in a maintenance position, changes the position of the nozzle heads to a nozzle head wiping position, and moves the wiper carrier in one direction. Then, nozzle head wipers attached to an upper portion of the wiper carrier are placed in contact with forward ends (lower ends) of the nozzle heads to wipe away the ink adhering to the nozzle heads.

However, the inkjet printing apparatus disclosed in Japanese Unexamined Patent Publication No. 2001-18406 goes through a complicated operation to move the nozzle heads to the nozzle head wiping position, then move the nozzle heads upward to an ink receiving member wiping position, and further return the nozzle heads to a printing position. This poses a problem in that the construction around the nozzle heads becomes complicated.

When, for example, a maintenance operation is carried out before starting printing by the inkjet printing apparatus, the nozzle heads kept on standby in the maintenance position which is a non-printing position are moved to the nozzle head wiping position above, and moved to the ink receiving member wiping position still above. After a wiping operation there, the nozzle heads are moved to the printing position. That is, the nozzle heads undergo a complicated operation to move upward, then move further upward and thereafter descend to a lowermost position. When the nozzle heads are put on standby in the maintenance position after the nozzles are wiped upon completion of printing by the inkjet printing apparatus, the nozzle heads similarly undergo a complicated operation to move upward, then move further upward and thereafter descend to the lowermost position. Such positioning operation is inefficient, and the construction around the nozzle heads also becomes complicated.

It is desirable that the wipers for wiping the ink discharge nozzles have the least chance of damage through friction. For this purpose, a mechanism is required for allowing the wipers to contact only the smooth inkjet heads, without contacting a component which supports the inkjet heads.

In addition, it is necessary to clean the wipers per se as necessary since ink accumulates on the wipers through operations for wiping the ink discharge heads.

Further, in such an inkjet printing apparatus, an ink storage tank is divided into a main tank and a subtank, and the subtank is disposed on an ink flow path between the main tank and inkjet heads. The ink is fed to the inkjet heads through this subtank. This is because, when an ink tank and the inkjet heads are directly connected without providing a subtank, there arises a problem of failing to discharge the ink steadily from the inkjet heads due to an amount of ink stored in the ink tank and other factors.

In the conventional inkjet printing apparatus, the subtank is fixed, separately from the inkjet heads, to the outside of an inkjet head holder holding the inkjet heads. On the other hand, the inkjet heads are movable up and down in order to perform a printing operation and a maintenance operation, which results in a difference in height between the inkjet heads and subtank. The difference in height between the inkjet heads and subtank spoils the meniscus of the ink in the inkjet heads. This makes an accurate discharge of ink impossible, and causes printing failures such as missing nozzle.

Japanese Unexamined Patent Publication No. 2004-358946 discloses an inkjet printing apparatus which moves an intermediate tank up and down to vary its height relative to a recording head and control ink back pressure of the recording head, thereby to improve a degree of freedom for arranging the intermediate tank and a main tank, and also realize space-saving. However, changing the height of the intermediate tank gives rise to a problem of making control of the ink discharge difficult, and only making uniform ink discharge impossible.

SUMMARY OF THE INVENTION

A first object of this invention, therefore, is to provide an inkjet printing apparatus which can reduce occupancy space when head caps are moved to a withdrawn position.

A second object of this invention is to provide an inkjet printing apparatus which enables an efficient maintenance operation without complicating a construction of a printing unit.

A third object of this invention is to provide an inkjet printing apparatus which can always discharge ink accurately also when inkjet heads are moved up and down.

The first object of this invention noted above is fulfilled by an inkjet printing apparatus for performing printing by moving a printing medium relative to inkjet heads each with a plurality of liquid discharge nozzles, comprising an inkjet head holder for holding a plurality of inkjet head rows arranged in a moving direction of the recording medium, each of the inkjet head rows having the inkjet heads over a width in a transverse direction of the recording medium intersecting the moving direction of the recording medium; a lift mechanism for moving the inkjet head holder up and down; a plurality of head caps corresponding to the plurality of inkjet heads held by the inkjet head holder; a plurality of head cap holders for holding the plurality of head caps in a state corresponding to the respective inkjet heads, and as divided into a plurality of areas with respect to the moving direction of the recording medium; and a head cap holder moving mechanism for arranging the plurality of head cap holders as horizontally juxtaposed in a capping position, where the respective inkjet heads and the respective head caps are opposed to each other, below the inkjet head holder when the inkjet head holder is in a raised position, and for arranging the plurality of head cap holders as vertically superposed in a withdrawn position laterally of a vertical movement area of the inkjet head holder when the inkjet head holder is in a lowered position.

Such inkjet printing apparatus can reduce a required occupancy space for the head caps when the head caps are moved to the withdrawn position.

In another aspect of this invention, the head cap holder moving mechanism includes bearings attached to opposite ends of each of the head cap holders; guide plates having guide grooves formed therein for engaging the bearings, each guide groove having a region for up-and-down movement and a region for horizontal movement; and a drive device connected to an end of each of the head cap holders for moving the head cap holders along the guide grooves.

Such inkjet printing apparatus, although simple in construction, can easily reciprocate the plurality of head cap holders between the capping position and the withdrawn position.

The second object of this invention noted above is fulfilled by an inkjet printing apparatus further comprising a wiping unit having wiping members for wiping liquid discharge nozzle forming surfaces of the inkjet heads; and a wiping unit moving mechanism for moving the wiping unit; wherein the lift mechanism is arranged to move the inkjet head holder up and down, thereby to move the inkjet heads between a standby position and a discharge position for causing the liquid discharge nozzles to discharge a liquid toward the recording medium; and wherein the wiping unit is arranged, when the inkjet heads are arranged in a position between the standby position and the discharge position, to be moved by the wiping unit moving mechanism to reciprocate in a direction perpendicular to the moving direction of the recording medium, thereby causing the wiping members to wipe the liquid discharge nozzle forming surfaces of the inkjet heads.

According to such inkjet printing apparatus, the wiping unit wipes the liquid discharge nozzles while the inkjet heads move from the standby position to the discharge position before ink discharge from the liquid discharge nozzles. The wiping unit wipes the liquid discharge nozzles also while the inkjet heads move from the discharge position to the standby position after ink discharge from the liquid discharge nozzles. This realizes an efficient maintenance operation which always keeps the liquid discharge nozzles clean.

In a further aspect of this invention, the wiping unit includes a wiping member lift device for moving the wiping members up and down, the wiping member lift device being arranged to move the wiping members up and down when the wiping unit is moved by the wiping unit moving mechanism, thereby wiping only the liquid discharge nozzle forming surfaces of the inkjet heads.

According to such inkjet printing apparatus, since the wiping members are moved up and down, the wiping members can be moved to positions for contacting the liquid discharge nozzle forming surfaces of the inkjet heads only when wiping the liquid discharge nozzles. This prevents contact between the wiping members and members supporting other inkjet heads, for example, thereby to inhibit damage to the wiping members.

The third object of this invention noted above is fulfilled by an inkjet printing apparatus further comprising a main tank for storing ink; a subtank disposed in an ink flow path between the main tank and the inkjet heads; and a subtank lift device for moving the subtank up and down synchronously with up-and-down movement of the inkjet heads occurring with up-and-down movement of the inkjet head holder.

Such inkjet printing apparatus can always discharge ink accurately also when the inkjet heads are moved up and down.

In a further aspect of this invention, the subtank lift device includes a connecting member for connecting the inkjet head holder and the subtank, the connecting member causing the subtank to move up and down synchronously with the inkjet heads, thereby to move the subtank and the inkjet heads to move up and down synchronously.

According to such inkjet printing apparatus, an extremely simple construction is provided to maintain a constant height relationship between the inkjet heads and subtank. Thus, ink can always be discharged accurately from the inkjet heads.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
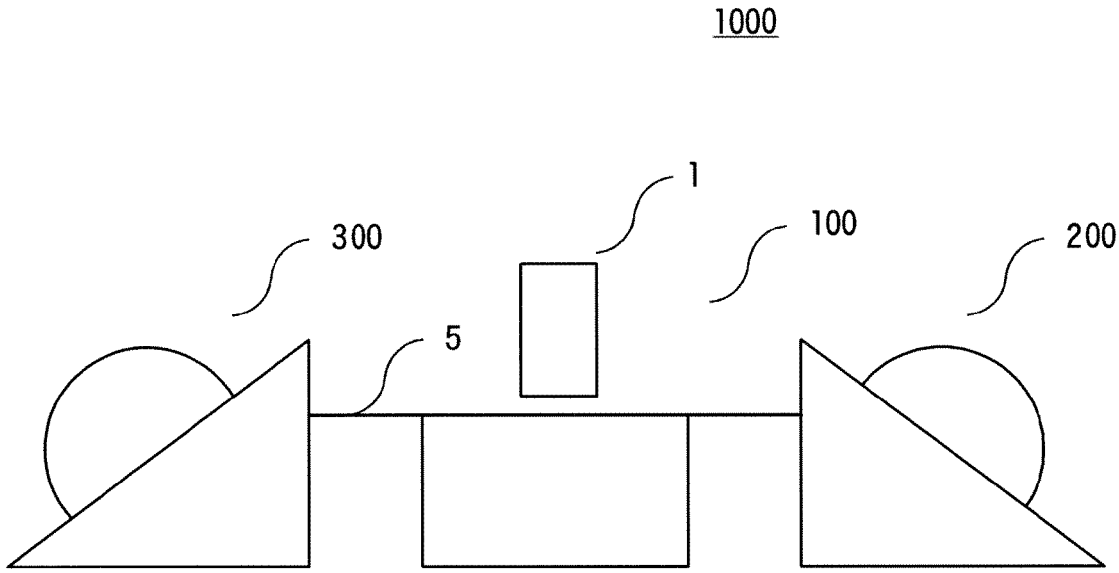
FIG. 1 is a schematic view of a printing system incorporating an inkjet printing apparatus according to this invention.
Figure 2:
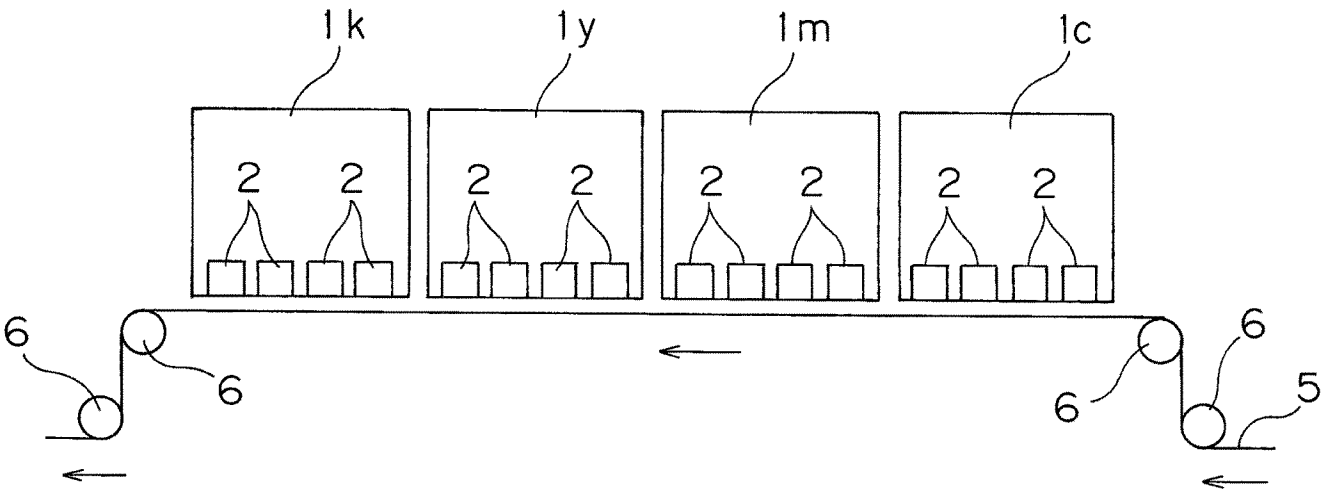
FIG. 2 is a schematic view of a principal portion of the inkjet printing apparatus.

Embodiments of this invention will be described hereinafter with reference to the drawings. FIG. 1 is a schematic view of a printing system 1000 incorporating an inkjet printing apparatus 100 according to this invention. FIG. 2 is a schematic view of a principal portion of the inkjet printing apparatus 100.

The printing system 1000 shown in FIG. 1 includes the inkjet printing apparatus 100, a recording medium feeding apparatus 200 and a recording medium takeup apparatus 300.

The recording medium feeding apparatus 200 stores printing paper 5 acting as recording medium in the form of a roll, and feeds the printing paper 5 for recording thereon in the inkjet printing apparatus 100.

The recording medium takeup apparatus 300 takes up the printing paper 5 recorded in the inkjet printing apparatus 100, for storage in the form of a roll.

The printing paper 5 is a recording medium in the form of a web having a predetermined width. This printing system 1000 can record on recording media such as paper, soft resin, thin metal film and so on.

The inkjet printing apparatus 100 continuously records images and the like by discharging a recording liquid from a printing unit 1 onto the web-shaped printing paper 5 fed from the recording medium feeding apparatus 200 and taken up by the recording medium takeup apparatus 300, As the recording liquid, ink can be used, for example. A functional solution such as resist or protein may also be used.

Figure 17:
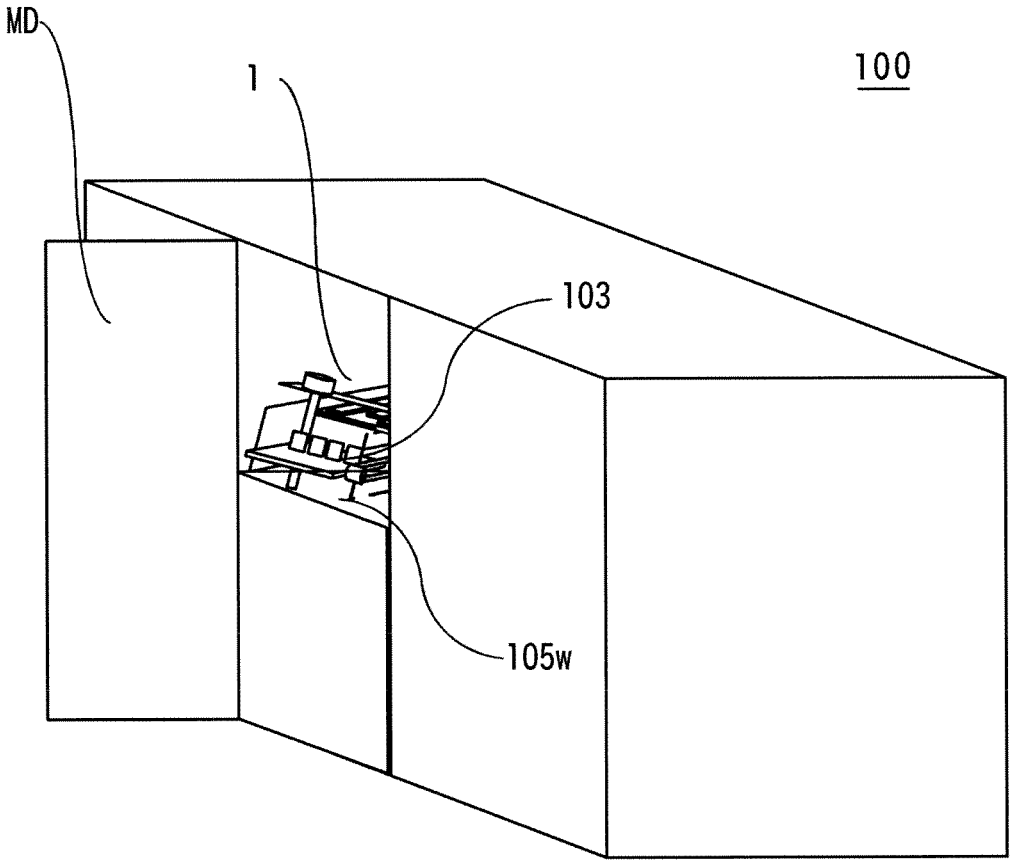
FIG. 17 is a view showing an open state of a maintenance door provided for the inkjet printing apparatus.

Although the printing unit 1 is shown as exposed for the purpose of description, the printing unit 1 is, in practice, as shown in FIG. 17 to be described hereinafter, enclosed in a housing of the inkjet printing apparatus 100 in order to assure recording quality with respect to the printing paper 5.

When the inkjet printing apparatus 100 is used for multicolor printing, the printing unit 1, as shown in FIG. 2, includes a printing unit 1*c* for printing the printing paper 5 in cyan ink, a printing unit 11 for printing the printing paper 5 in magenta ink, a printing unit 1*y* for printing the printing paper 5 in yellow ink, and a printing unit 1*k* for printing the printing paper 5 in black ink. Each of the printing units 1*c*, 1*m*, 1*y* and 1*k* has inkjet heads 2 arranged over a range substantially corresponding to a width of the printing paper 5 (which is normal to the plane of FIG. 2) perpendicular to a moving direction of the printing paper 5 indicted by arrows in FIG. 2, and four rows of the inkjet heads 2 are arranged in the moving direction of the printing paper 5 as described hereinafter. Four-color printing in cyan, magenta, yellow and black is performed by inkjet mode on the printing paper 5 fed from the recording medium feeding apparatus 200 and moving in the direction of the arrows shown in FIG. 2, under guiding action of guide rollers 6.

Figure 3:
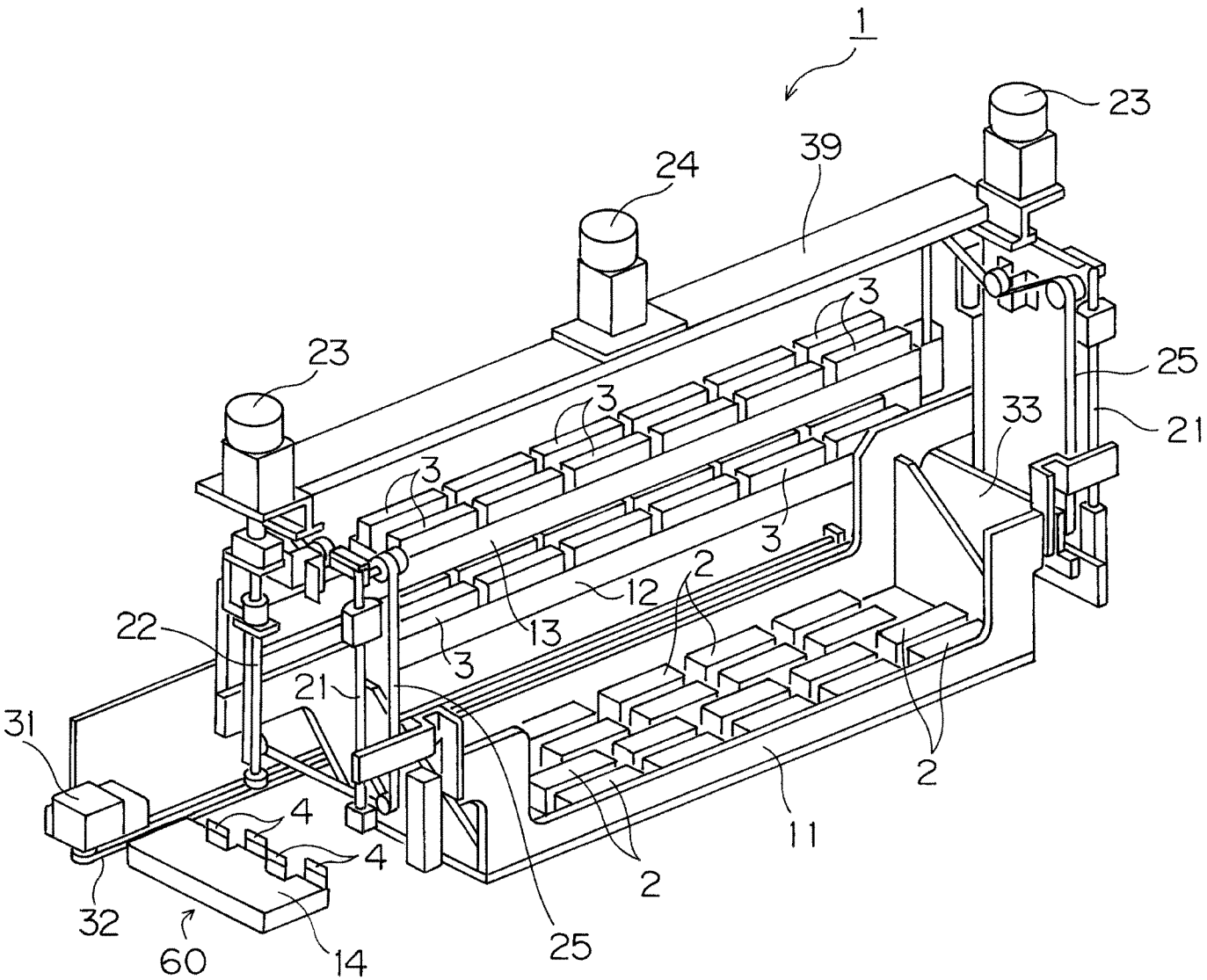
FIG. 3 is a perspective view of a printing unit.
Figure 4:
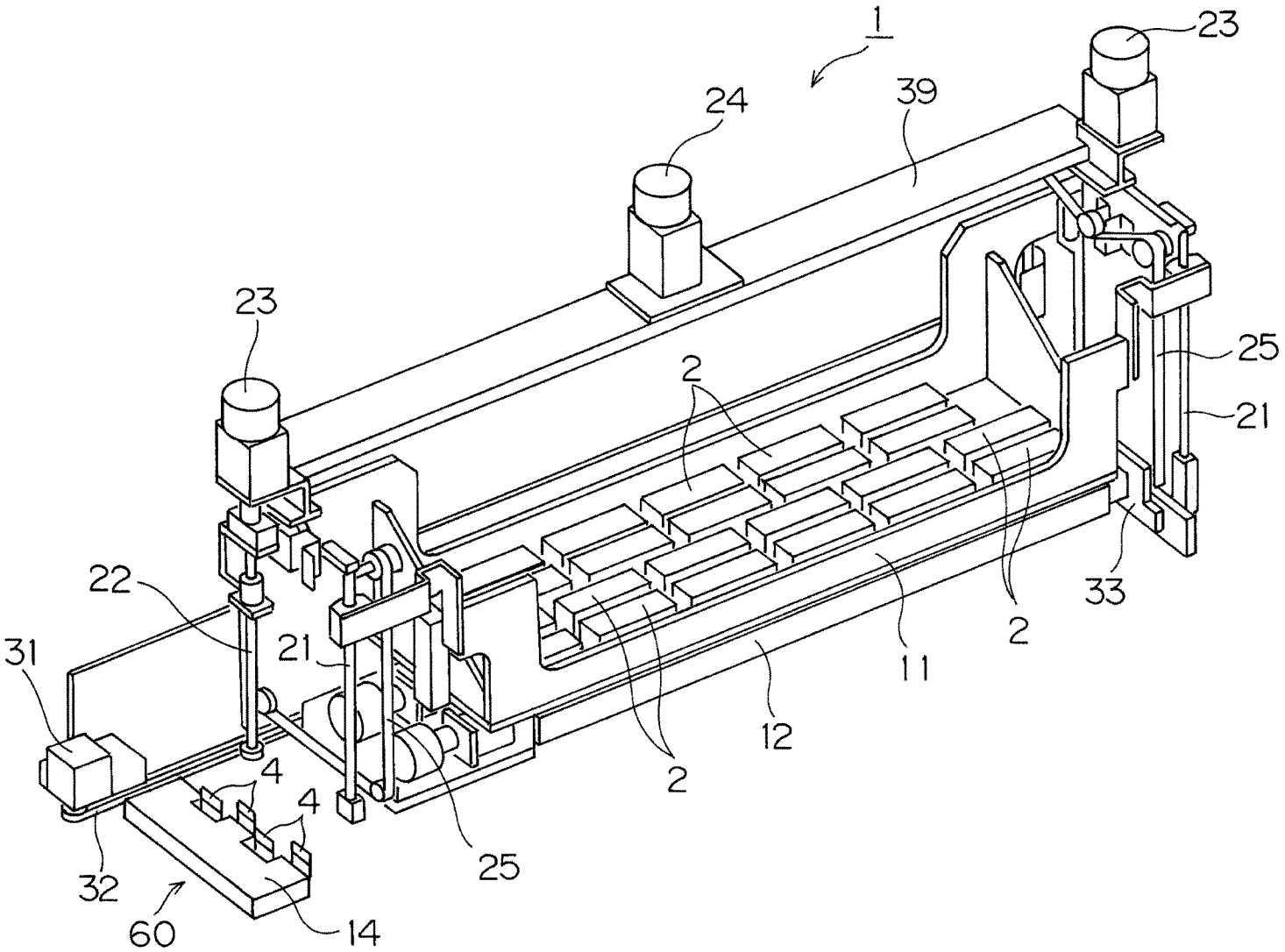
FIG. 4 is a perspective view of the printing unit.
Figure 5:
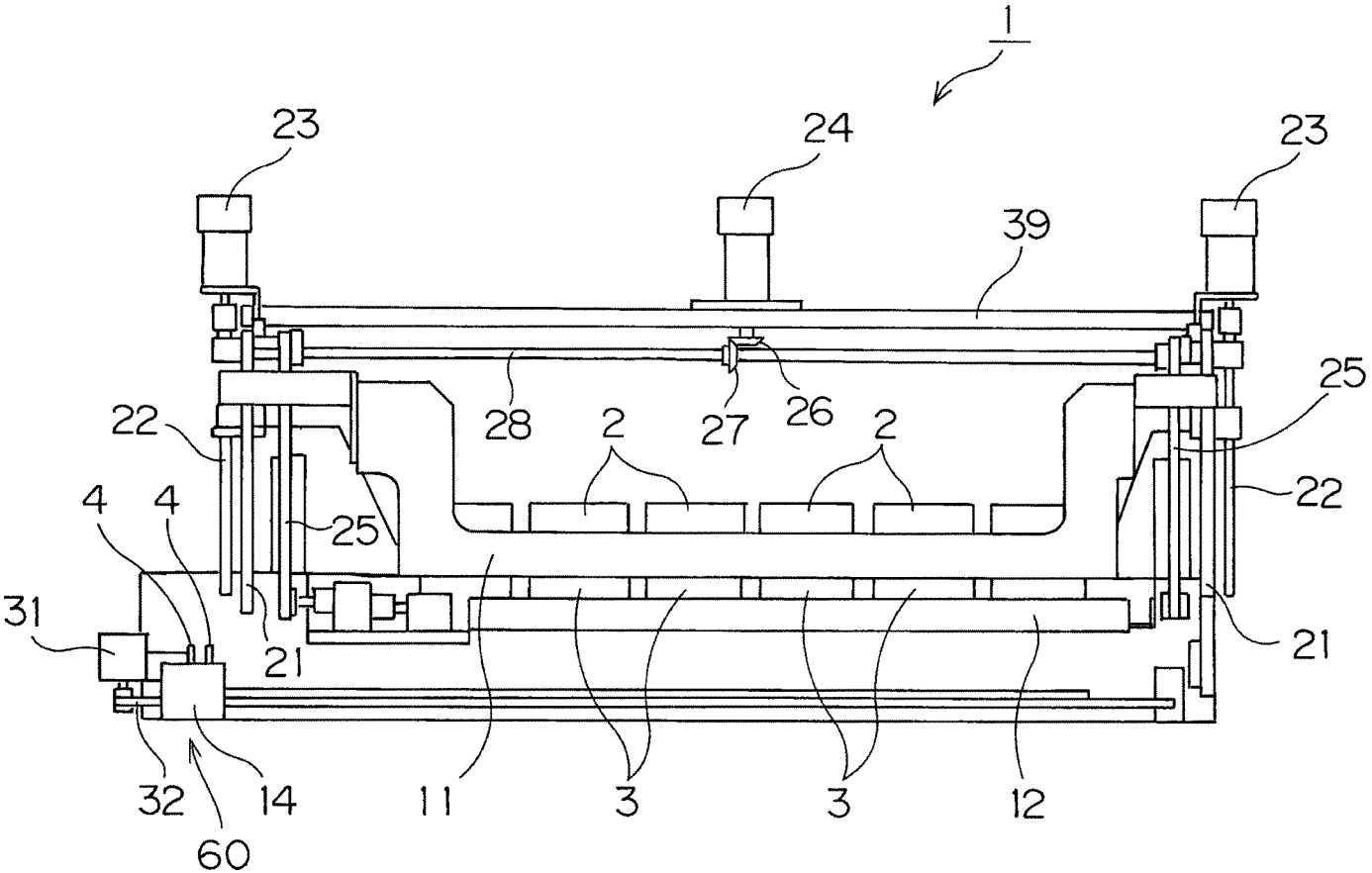
FIG. 5 is a front view of the printing unit.
Figure 6:
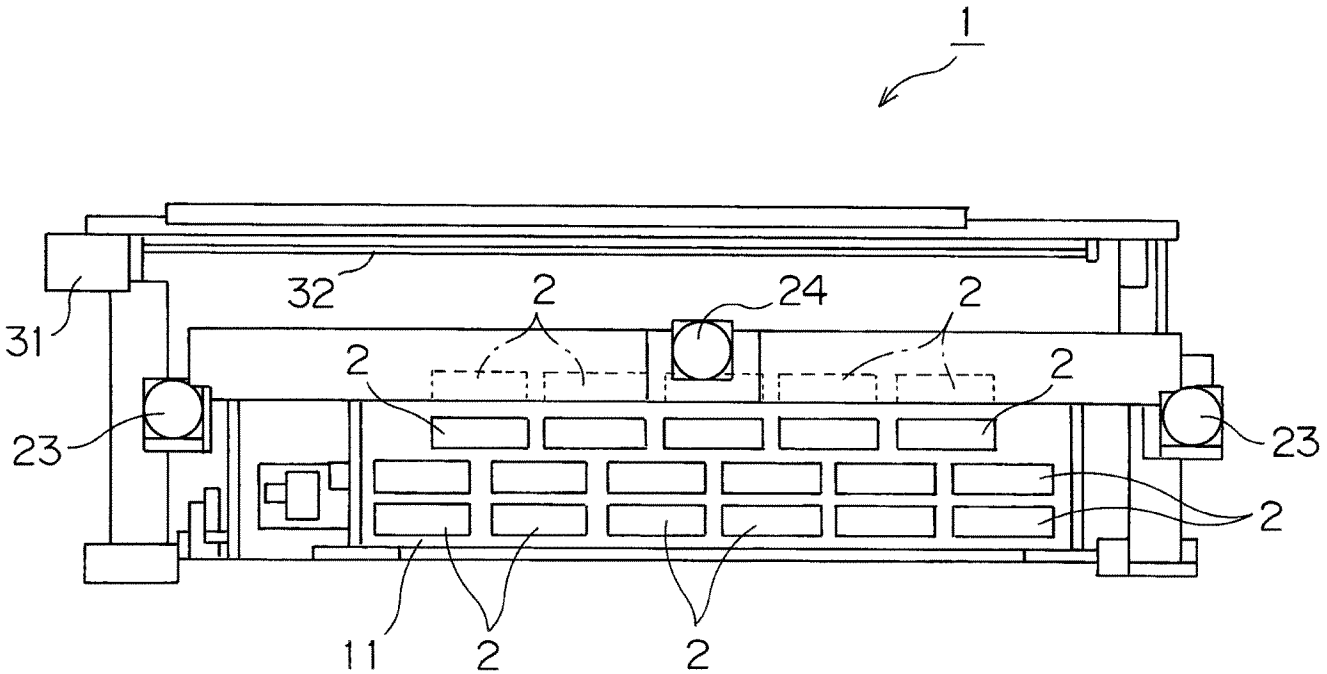
FIG. 6 is a plan view of the printing unit.
Figure 7:
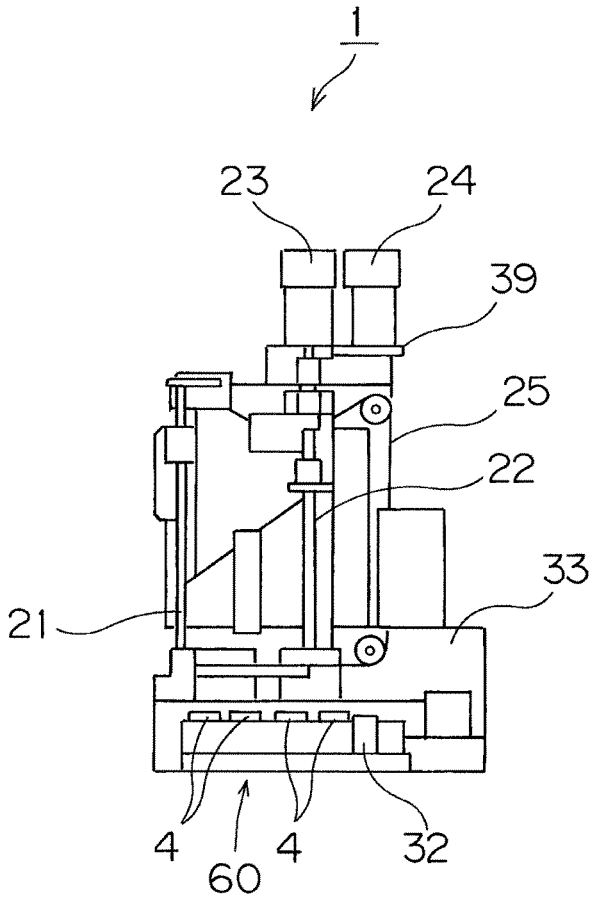
FIG. 7 is a side view of the printing unit.

Next, the construction of the printing units 1*c*, 1*m*, 1*y* and 1*k* will be described. The printing units 1*c*, 1*m*, 1*y* and 1*k* have in general the same construction except the types of ink used. Therefore, each of the printing units 1*c*, 1*m*, 1*y* and 1*k* will be called and described as the printing unit 1 hereinafter. FIGS. 3 and 4 are perspective views of the printing unit 1. FIG. 5 is a front view of the printing unit 1. FIG. 6 is a plan view of the printing unit 1. FIG. 7 is a side view of the printing unit 1. FIG. 3 shows a state in which a pair of head cap holders 12 and 13 described hereinafter are arranged in a standby position. FIGS. 4 through 7 show a state in which the pair of head cap holders 12 and 13 are arranged in a capping position.

The printing unit 1 includes 22 inkjet heads 2 having a plurality of liquid discharge nozzles formed thereon, and an inkjet head holder 11 holding these inkjet heads 2 en bloc. The 22 inkjet heads 2 form inkjet head rows each having five or six inkjet heads 2 arranged end-to-end in the direction of width of the printing paper 5, so that the inkjet heads 2 are arranged over a range substantially corresponding to the width of the printing paper 5 perpendicular to the moving direction of the printing paper 5. The inkjet head holder 11 holds four such inkjet rows as arranged in the moving direction of the printing paper 5. The inkjet head rows are arranged such that certain of the inkjet head rows have the inkjet heads 2 with the liquid discharge nozzles partly overlapping the liquid discharge nozzles of the inkjet heads 2 forming the other inkjet head rows in the transport direction of the printing paper 5, so as to avoid recording omissions. These inkjet heads 2 are constructed to penetrate the inkjet head holder 11, to be able to discharge ink from the lower surface of the inkjet head holder 11. It should be noted that the number of inkjet heads 2 is not limited to 22.

The inkjet head holder 11 holding the inkjet heads 2 en bloc can move up and down as guided by linear guides 21. This inkjet head holder 11 is meshed with a pair of right and left ball screws 22 through nuts not shown. The pair of ball screws 22 are rotatable by a pair of motors 23 arranged on a frame 39. Thus, the inkjet head holder 11 is driven by the pair of motors 23 to move up and down. That is, the inkjet head holder 11 is driven by the pair of motors 23 to move up and down between a standby position, a cleaning position and a printing position described hereinafter. The mechanism for moving the inkjet head holder 11 up and down is constructed of the linear guides 21, the pair of ball screws 22 and the pair of motors 23 in this embodiment, but this is not limitative. Movement of the inkjet head holder 11 can be realized by employing a rack and pinion mode, a linear motor mode, an air cylinder mode or a cogged belt mode, for example.

The printing unit 1 further includes 22 head caps 3 arranged in a corresponding relationship to the 22 inkjet heads 2. These head caps 3 are provided to cap (cover) areas adjacent ink discharge portions including the liquid discharge nozzles of the inkjet heads 2, in order to prevent drying and contamination of the areas adjacent the ink discharge portions of the inkjet heads 2. The head caps 3 in two rows (i.e. 12 head caps 3) are held by the head cap holder 12, while the head caps 3 in the remaining two rows (i.e. ten head caps 3) are held by the other head cap holder 13. The number of head caps 3 corresponds to the number of inkjet heads 2, and is not limited to 22.

The pair of these head cap holders 12 and 13 are, in the state of holding the plurality of head caps 3, movable between a capping position below the inkjet head holder 11 and a withdrawn position laterally of a vertical movement area of the inkjet head holder 11.

Figure 8:
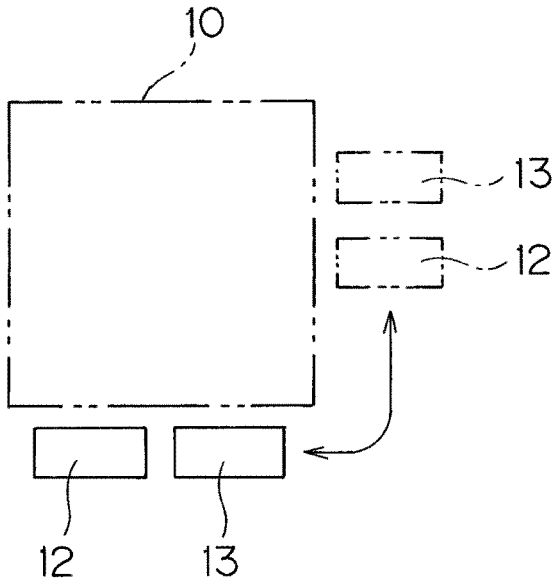
FIG. 8 is an explanatory view schematically showing a moving state of a pair of head cap holders.

FIG. 8 is an explanatory view schematically showing a moving state of the pair of head cap holders 12 and 13.

This figure shows a vertical movement area 10 of the inkjet head holder 11 in a two-dot chain line. As shown in this figure, the pair of head cap holders 12 and 13 are, in the state of holding the plurality of head caps 3, movable between a capping position, shown in solid lines in this figure, below the vertical movement area 10 of the inkjet head holder 11 and a withdrawn position, shown in phantom lines in this figure, laterally of the vertical movement area 10 of the inkjet head holder 11. In the capping position, the pair of head cap holders 12 and 13 are juxtaposed horizontally. In the withdrawn position, the pair of head cap holders 12 and 13 are arranged one over the other.

Figure 9:
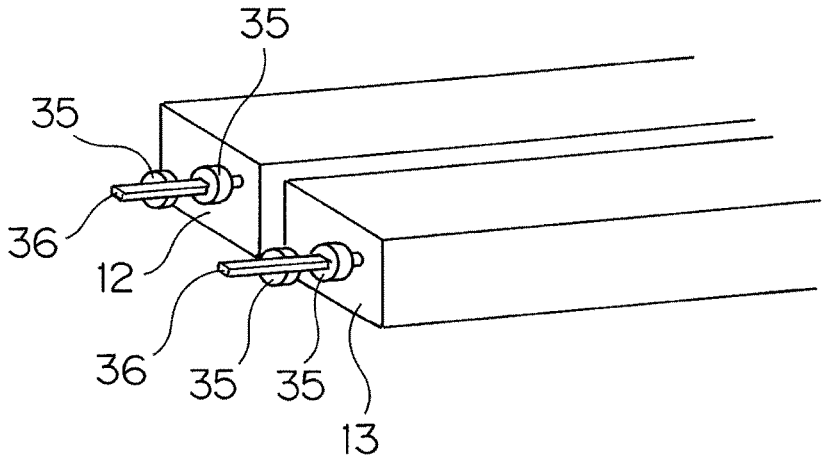
FIG. 9 is a perspective view showing bearings and connecting rods attached to opposite ends of the pair of head cap holders.
Figure 10:
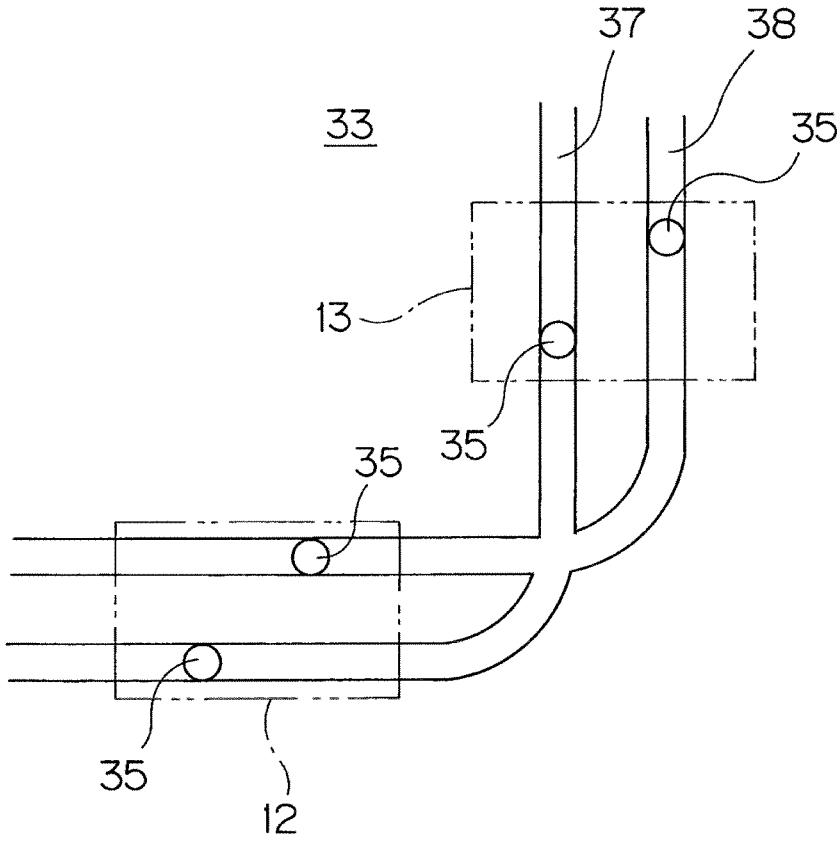
FIG. 10 is a schematic view showing guide grooves formed in a side panel.
Figure 11:
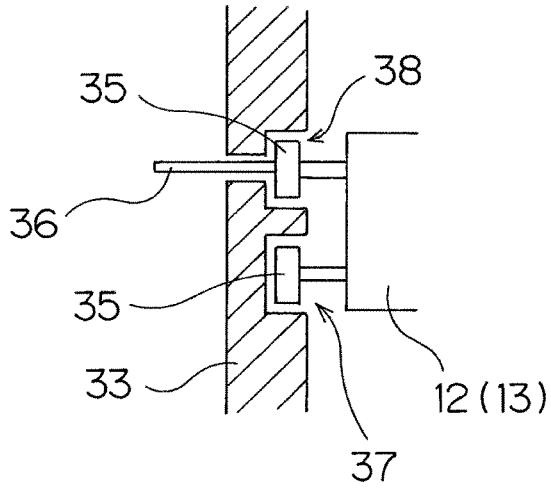
FIG. 11 is a schematic view showing an engaging relation between the guide grooves and bearings.

A moving mechanism of the pair of head cap holders 12 and 13 which is one of the characterizing features of this invention will be described hereinafter. FIG. 9 is a perspective view showing bearings 35 and connecting rods 36 attached to opposite ends of the pair of head cap holders 12 and 13. FIG. 10 is a schematic view showing guide grooves 37 and 38 formed in side panels 33. FIG. 11 is a schematic view showing an engaging relation between the guide grooves 37 and 38 and bearings 35.

The side panel 33 shown in FIGS. 3, 4 and 7 has guide grooves 37 and 38 of the same shape formed in positions shifted from each other as shown in FIG. 10. Each of these guide grooves 37 and 38 includes a vertically extending region for up-and-down movement and a horizontally extending region for horizontal movement. Each of the head cap holders 12 and 13 has a pair of bearings 35 attached to each of the opposite ends thereof as shifted horizontally and vertically from each other. A connecting rod 35 extends from one of the two bearings 35.

As shown in FIG. 11, one guide groove 37 of the pair of guide grooves 37 and 38 is recessed in the side panel 33. The other guide groove 38 has a pass-through slot penetrated by the connecting rod 36. As shown in FIG. 10, the vertically extending regions for up-and-down movement of the guide grooves 37 and 38 having the same shape are horizontally spaced from each other by a distance corresponding to an amount of horizontal shift between the pair of bearings 35. The horizontally extending regions for horizontal movement of the guide grooves 37 and 38 having the same shape are vertically spaced from each other by a distance corresponding to an amount of vertical shift between the pair of bearings 35.

As shown in FIGS. 3, 4, 5 and 7, a pair of right and left synchronous belts 25, each wound on a plurality of pulleys, are arranged adjacent the opposite ends of the pair of head cap holders 12 and 13. These synchronous belts 25 are arranged, by the plurality of pulleys, to extend along the vertically extending regions for up-and-down movement and horizontally extending regions for horizontal movement of the guide grooves 38 having the pass-through slots. As shown in FIG. 5, one of the pulleys on which each synchronous belt 25 is wound is connected to a motor 24 mounted on the frame 39, through a pair of bevel gears 26 and 27 and a rotary drive shaft 28. Therefore, the synchronous belts 25 are driven by the motor 24 to move along the guide grooves 38. The connecting rods 36 attached to the opposite ends of the pair of head cap holders 12 and 13 are connected to these synchronous belts 25.

Therefore, when the pair of right and left synchronous belts 25 are moved by drive of the motor 24, the pair of head cap holders 12 and 13, with the bearings 35 at the opposite ends thereof guided by the guide grooves 37 and 38, move between the withdrawn position shown in FIG. 3 and in the phantom lines FIG. 8, and the capping position shown in FIG. 4 and in the solid lines in FIG. 8. This withdrawn position is a position laterally of the vertical movement area of the inkjet head holder 11 as noted hereinbefore. In this withdrawn position, the pair of head cap holders 12 and 13 are arranged one over the other. The capping position is a position below the vertical movement area of the inkjet head holder 11 for the head caps 3 to cap the inkjet heads 2. In this capping position, the pair of head cap holders 12 and 13 are juxtaposed horizontally.

Referring to FIGS. 3 through 7 again, a wiping unit 60 having four wiper blades 4 is disposed at one end below the inkjet head holder 11 and the pair of head cap holders 12 and 13. The wiper blades 4 are wiping members formed of rubber, synthetic resin or the like for contacting liquid discharge nozzle forming surfaces of the inkjet heads 2 with a predetermined pressure to scrape off ink and dust adhering to these surfaces. The four wiper blades 4 are held by a wiper blade holder 14 of the wiping unit 60, and are arranged in positions corresponding to the four rows of the inkjet heads 2 held by the inkjet head holder 11. This wiper blade holder 14 is connected at one end thereof to a synchronous belt 32 movable by drive of a motor 31. Therefore, this wiper blade holder 14 is reciprocable by drive of the motor 31 in the direction of arrangement of the inkjet heads 2 (in the direction perpendicular to the moving direction of the printing paper). With movement of the wiper blade holder 14 in the direction of arrangement of the inkjet heads 2, the lower surfaces of the respective inkjet heads 2 are cleaned by the wiper blades 4.

Figure 12A:
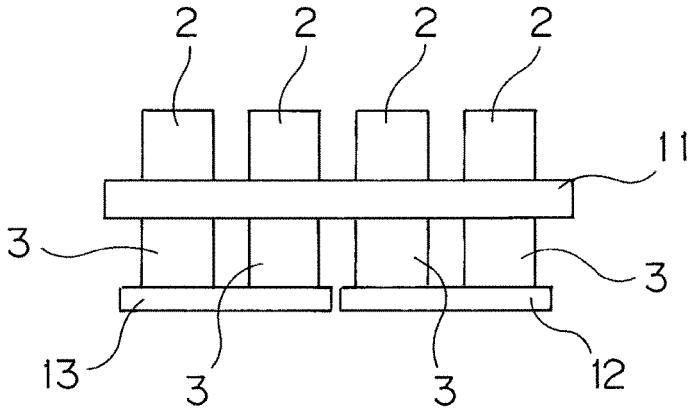
FIG. 12A is an explanatory view illustrating a height position of the inkjet head holder in a state where the head cap holders are arranged in a capping position.
Figure 12B:
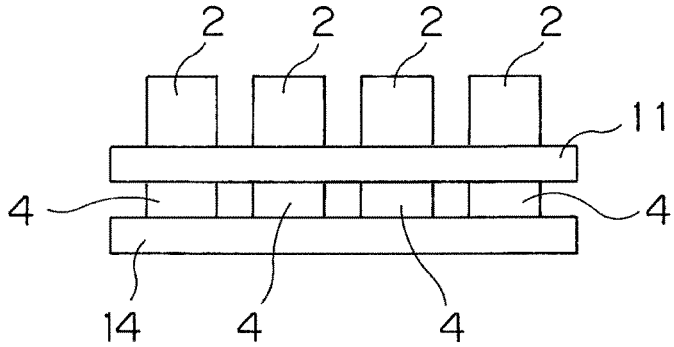
FIG. 12B is an explanatory view illustrating a height position of the inkjet head holder at a time of cleaning inkjet heads.
Figure 12C:
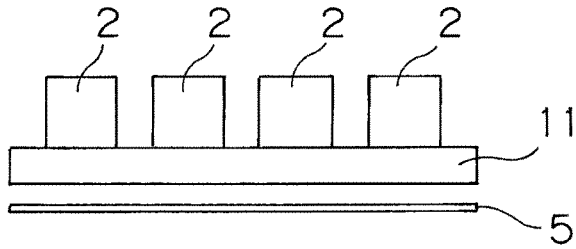
FIG. 12C is an explanatory view illustrating a height position of the inkjet head holder at a time of printing execution.

FIGS. 12A-12C are explanatory views illustrating height positions of the inkjet head holder 11 in the various states noted above.

FIG. 12A shows a height position of the inkjet head holder 11 in the state where the head cap holders 12 and 13 are placed in the capping position. FIG. 12B shows a height position of inkjet head holder 11 at a time of cleaning the inkjet heads 2. FIG. 12C shows a height position of the inkjet head holder 11 at a time of printing execution.

When the pair of head cap holders 12 and 13 are placed in the capping position as shown in FIGS. 4 through 7, the inkjet head holder 11 is in the height position shown in FIG. 12A which is higher than the other positions shown in FIGS. 12B and 12C. In this state, i.e. the state where the inkjet heads 2 are in the standby position, the areas adjacent the ink discharge portions including the liquid discharge nozzles of the inkjet heads 2 are capped by the head caps 3 to prevent drying and contamination of the areas adjacent the ink discharge portions of the inkjet heads 2.

On the other hand, at the time of cleaning the inkjet heads 2, as shown in FIG. 12B, the inkjet head holder 11 descends until the lower surfaces of the inkjet heads 2 reach a position (cleaning position) contactable by the wiper blades 4. Then, the wiper blade holder 14 moves, by drive of the motor 31, in the direction of arrangement of the inkjet heads 2 (in the direction perpendicular to the moving direction of the printing paper). With this movement, the lower surfaces of the inkjet heads 2 are wiped and cleaned by the wiper blades 4. At this time, the pair of head cap holders 12 and 13 are arranged one over the other in the withdrawn position laterally of the vertical movement area 10 of the inkjet head holder 11.

Further, at the time of printing execution, as shown in FIG. 12C, the inkjet head holder 11 is further lowered until the lower surfaces of the inkjet heads 2 reach a position (printing position) close to the printing paper 5 moving as guided by the guide rollers 6. At this time also, the pair of head cap holders 12 and 13 are arranged one over the other in the withdrawn position laterally of the vertical movement area 10 of the inkjet head holder 11.

In the inkjet printing apparatus 100 according to this invention, as described above, when printing is not carried out, the pair of head cap holders 12 and 13 are horizontally juxtaposed below the vertical movement area 10 of the inkjet head holder 11. Consequently, the areas adjacent the ink discharge portions of the inkjet heads 2 are capped by the head caps 3 to prevent drying and contamination of the areas adjacent the ink discharge portions of the inkjet heads 2.

On the other hand, when printing is carried out and when the wiper blades 4 clean the inkjet heads 2, the pair of head cap holders 12 and 13 are arranged one over the other in the withdrawn position laterally of the vertical movement area 10 of the inkjet head holder 11. This realizes a reduced occupancy space of the head caps 3 moved to the withdrawn position.

In the foregoing embodiment, the 22 head caps 3 are divided into two parts to be held by the pair of head cap holders 12 and 13. These head caps may be divided into three or more parts to be held by three or more head cap holders. In this case also, a plurality of head cap holders may be horizontally juxtaposed in the capping position below the vertical movement area 10 of the inkjet head holder 11, and arranged one over the other in the withdrawn position laterally of the vertical movement area 10 of the inkjet head holder 11, thereby to reduce the occupancy space.

In the foregoing embodiment, ink jet printing is performed by moving the printing paper 5 in one direction. Instead, ink jet printing may be performed by moving the inkjet heads 2 relative to the printing paper.

Figure 13:
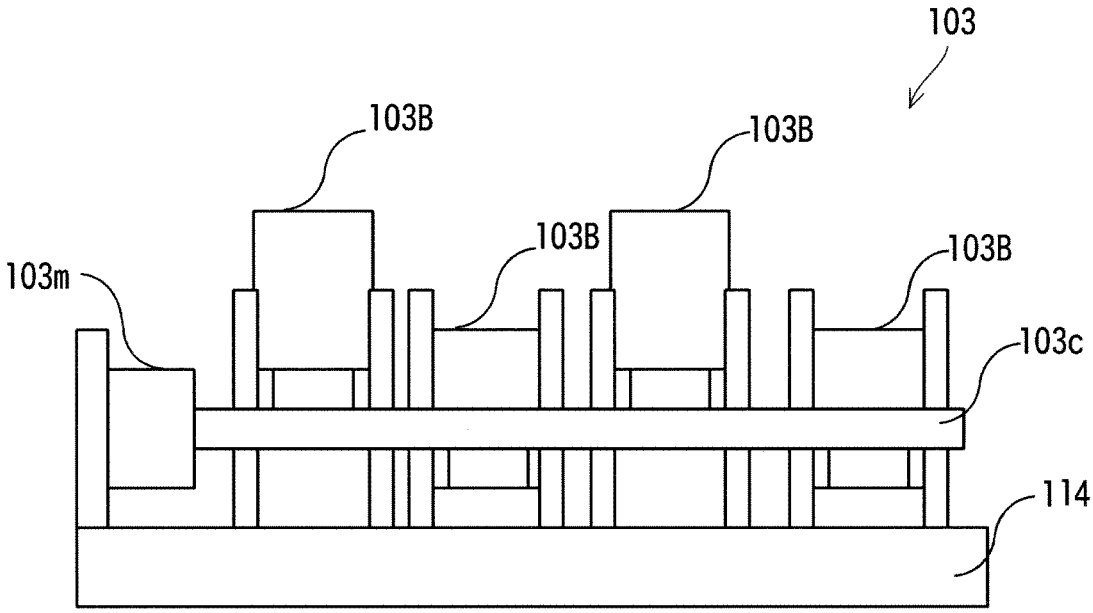
FIG. 13 is a schematic view showing a construction of a wiper blade holder according to another embodiment.

FIG. 13 is a view illustrating a construction of a wiping unit 103 according to another embodiment.

The wiping unit 103, as in the foregoing embodiment, includes four wiper blades 103B for wiping the lower surfaces of the inkjet heads 2. These four wiper blades 103B are held by a wiper blade holder 114, and are arranged in positions corresponding to the four rows of the inkjet heads 2 held by the inkjet head holder 11. This wiper blade holder 114 has, as a mechanism for raising and lowering the wiper blades 103B, a drive motor 103*m* and a cam shaft 103*c* driven by the drive motor 103*m*.

The drive motor 103*m* is a stepping motor which is operable by a control signal from a controller, not shown, of the printing system 1000, to rotate the cam shaft 103*c* and push up the wiper blades 103B. Since the control signal is transmitted when the wiper blades 103B have come to positions capable of wiping the inkjet heads 2, the wiper blades 103B are pushed up to wipe only the inkjet heads 2. The wiper blades 103B pushed up wipe away the liquid adhering to the liquid discharge nozzle forming surfaces of the inkjet heads 2 and dust transferred to these surfaces from the printing paper 5. After the wiping action the wiper blades 103B move downward, and therefore the wiper blades 103B never wipe anything other than the liquid discharge nozzle forming surfaces of the inkjet heads 2.

FIGS. 14A-14D are views illustrating movement of the inkjet heads 2 to a discharge position d1.

Figure 14A:
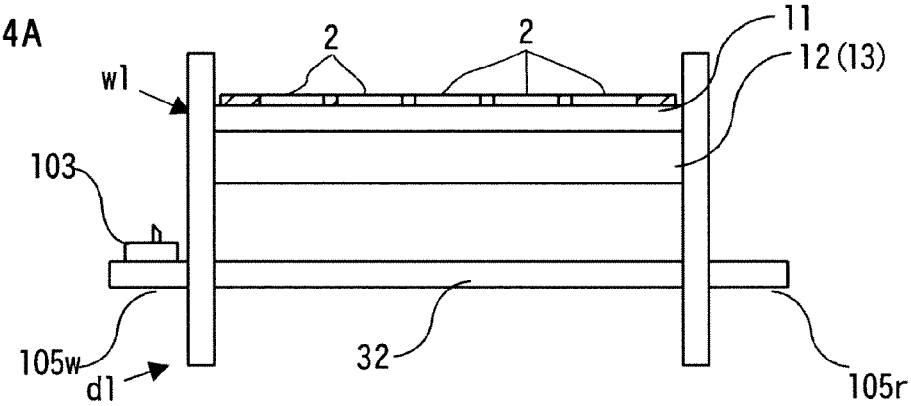
FIG. 14A is an explanatory view of movement of the inkjet heads to a discharge position.

FIG. 14A shows a state of the printing unit 1 when the printing system 1000 is in a standby state. When the printing system 1000 is in the standby state, the inkjet heads 2 are located in a standby position w1 in an upper portion of the printing unit 1. With the head cap holders 12 and 13 arranged in the capping position, the head caps 3 cover the liquid discharge nozzle forming surfaces of the plurality of inkjet heads 2 held by the inkjet head holder 11. The wiping unit 103 is located in a wiping unit standby position 105*w*.

Figure 14B:
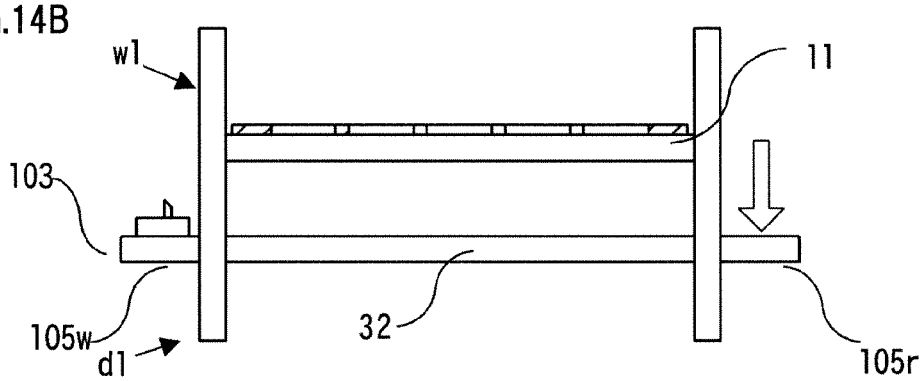
FIG. 14B is an explanatory view of movement of the inkjet heads to the discharge position.

FIG. 14B shows a state in which operation of the printing system 1000 has started. When the printing system 1000 starts operation, the motor 24, based on a predetermined control signal, drives the head cap holders 12 and 13 to remove the head cap 3 from the inkjet heads 2. At this time, the head cap holders 12 and 13 move to the withdrawn position shown in FIGS. 3 and 8.

The motors 23, based on a predetermined control signal, drive and move the inkjet head holder 11, to move the inkjet heads 2 from the standby position w1 to the discharge position d1.

Figure 14C:
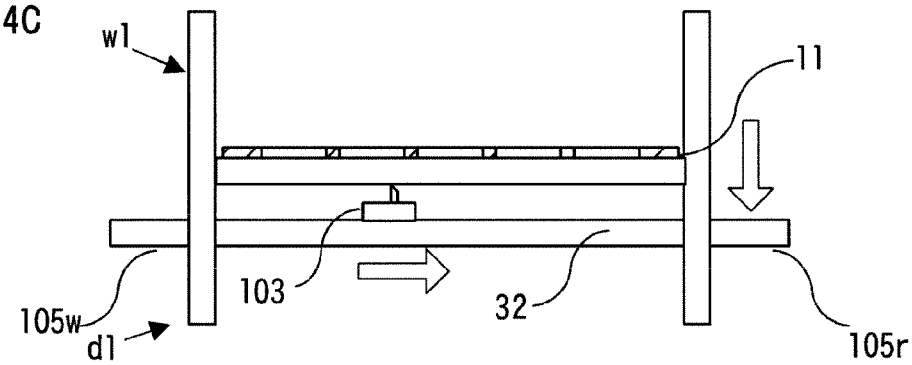
FIG. 14C is an explanatory view of movement of the inkjet heads to the discharge position.

FIG. 14C shows a state of the motors 23 having stopped driving based on a predetermined control signal, to suspend movement of the inkjet head holder 11 with the inkjet heads 2 arranged in a cleaning position. At this time, the motor 31 drives forward the wiping unit 103 connected to the synchronous belt 32, whereby the wiper blades 103B wipe the lower surfaces of the plurality of inkjet heads 2 supported by the inkjet head holder 11 having descended from the standby position w1 and is temporarily at rest. The wiping unit 103 having moved to a wiping unit return position 105*r* through this wiping operation is moved backward by drive of the motor 31 to return to the wiping unit standby position 105*w*. In this embodiment, the mechanism for reciprocating the wiping unit 103 is constructed of the synchronous belt 32 and motor 31, but this is not limitative. The movement of the wiping unit 103 can be realized by employing a rack and pinion mode, a linear motor mode or a ball screw mode, for example.

Figure 14D:
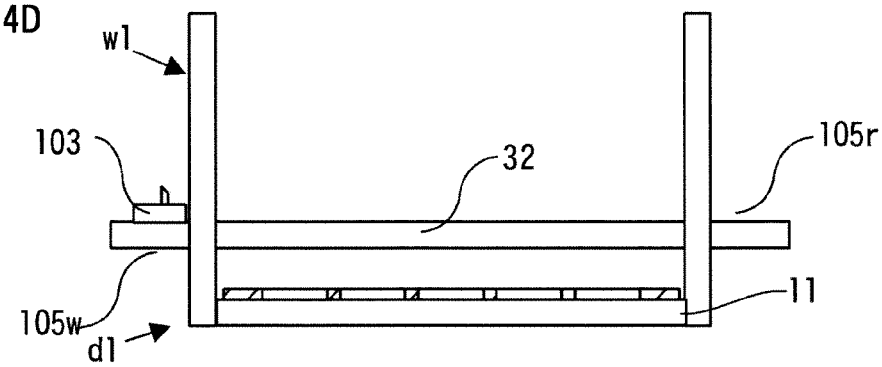
FIG. 14D is an explanatory view of movement of the inkjet heads to the discharge position.

FIG. 14D shows a state in which the printing system 1000 has started recording. The motors 23 drive and resume movement of the inkjet head holder 11 kept temporarily at rest, whereby the inkjet heads 2 are lowered to the discharge position d1. From the inkjet heads 2 located in the discharge position d1, a liquid such as ink is discharged based on predetermined recording signals. That is, the printing unit 1 carries out printing on the printing paper 5 transported.

FIGS. 15A-15D are views illustrating movement of the inkjet heads 2 to the standby position w1.

Figure 15A:
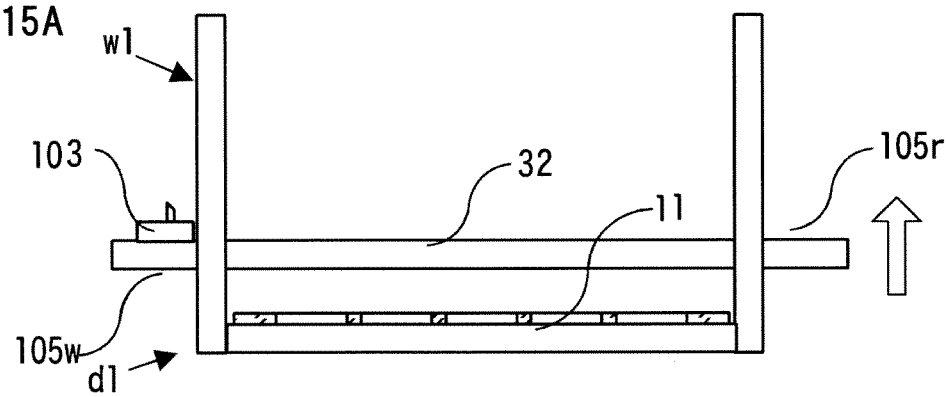
FIG. 15A is an explanatory view of movement of the inkjet heads to a standby position.

FIG. 15A shows a state immediately before the printing system 1000 completes its operation. After printing by the printing unit 1 is completed, the motors 23 are operated, based on a predetermined control signal, to move the inkjet heads 2 from the discharge position d1 to the standby position w1.

Figure 15B:
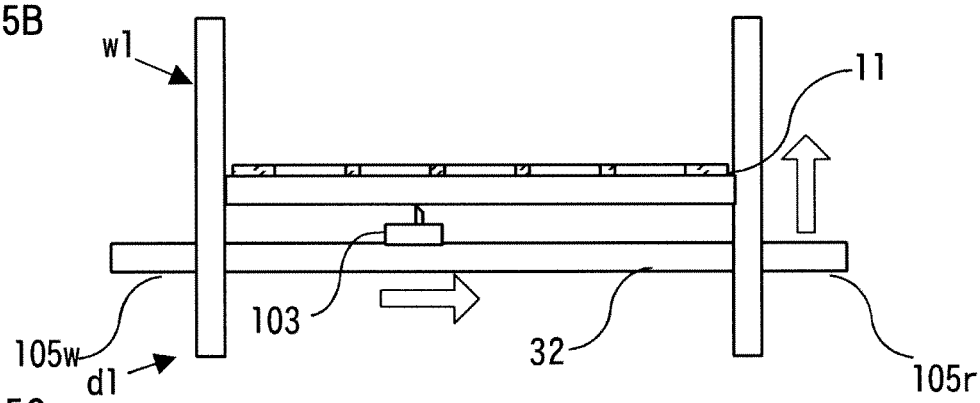
FIG. 15B is an explanatory view of movement of the inkjet heads to the standby position.

In FIG. 15B, the movement of the inkjet head holder 11 is suspended based on a predetermined control signal, and the motor 31 drives forward the wiping unit 103 connected to the synchronous belt 32, whereby the wiper blades 103B wipe the lower surfaces of the plurality of inkjet heads 2 supported by the inkjet head holder 11 having ascended from the discharge position d1 and is temporarily at rest. The wiping unit 103 having moved to the wiping unit return position 105*r* through the wiping operation is moved backward by drive of the motor 31 to return to the wiping unit standby position 105*w*.

Figure 15C:
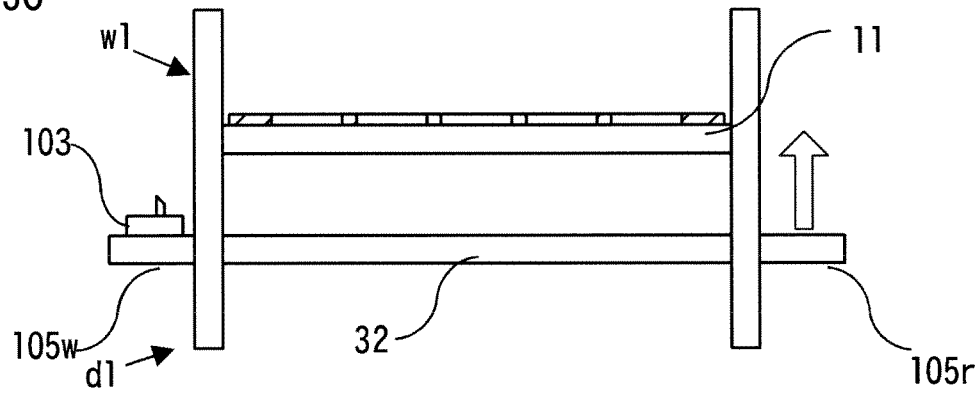
FIG. 15C is an explanatory view of movement of the inkjet heads to the standby position.

After completion of the wiping operation, as shown in FIG. 15C, the movement of the inkjet head holder 11 is resumed to move the inkjet heads 2 toward the standby position w1.

Figure 15D:
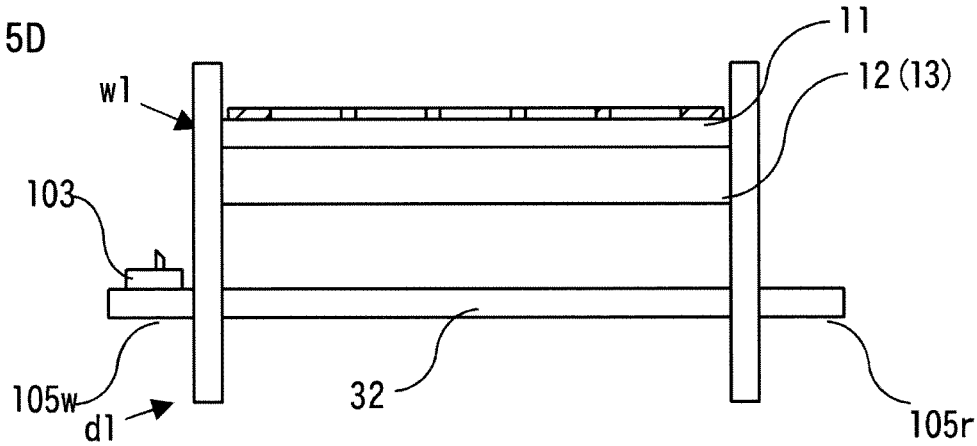
FIG. 15D is an explanatory view of movement of the inkjet heads to the standby position.

FIG. 15D shows a state of the operation of the printing system 1000 having been completed. The inkjet head holder 11 is raised by drive of the motors 23 as guided by the linear guides 21, whereby the inkjet heads 2 are arranged in the standby position w1. The motor 24 is driven based on a predetermined control signal, to move the head cap holders 12 and 13 relative to the inkjet heads 2 arranged in the standby position w1, from the withdrawn position to the capping position shown in FIGS. 3 and 8. The head cap holders 12 and 13 arranged in the capping position cover with the head caps 3 the plurality of inkjet heads 2 held by the inkjet head holder 11.

As described above, the inkjet heads 2 held by the inkjet holder 11, with start of operation of the printing system 1000, move from the standby position w1 in the upper portion to the discharge position d1 in the lower portion of the printing unit 1, and with completion of operation of the printing system 1000, move from the discharge position d1 in the lower portion to the standby position w1 in the upper portion of the printing unit 1. During the movement of inkjet heads 2 between the discharge position d1 and standby position w1, at each of the time of descent and the time of ascent of the inkjet holder 11, the wiping unit 103 wipes the liquid discharge nozzle forming surfaces of the inkjet heads 2.

The wiping operation by the wiping unit 103 is carried out halfway in the movements of the inkjet heads 2 from the standby position w1 to the discharge position d1 and from the discharge position d1 to the standby position w1. Thus, the inkjet head holder 11 holding the inkjet heads 2 does not make an unnatural up-and-down motion for wiping purposes only. Therefore, the construction of the printing unit 1 is not complicated. Since the wiping by the wiping unit 103 is reliably carried out before and after discharge of the ink from the liquid discharge nozzles of the inkjet heads 2, an efficient maintenance operation is realized to render the liquid discharge nozzles of the plurality of inkjet heads 2 constantly clean.

FIGS. 16A-16D are views illustrating wiping operation of the wiping unit 103, which focus on movement of the wiper blades 103B.

Here, for expediency of the description, the figures show wiping operation of the wiping unit 103 when the inkjet heads 2 are arranged in one row in the transport direction of the printing paper 5.

Figure 16A:
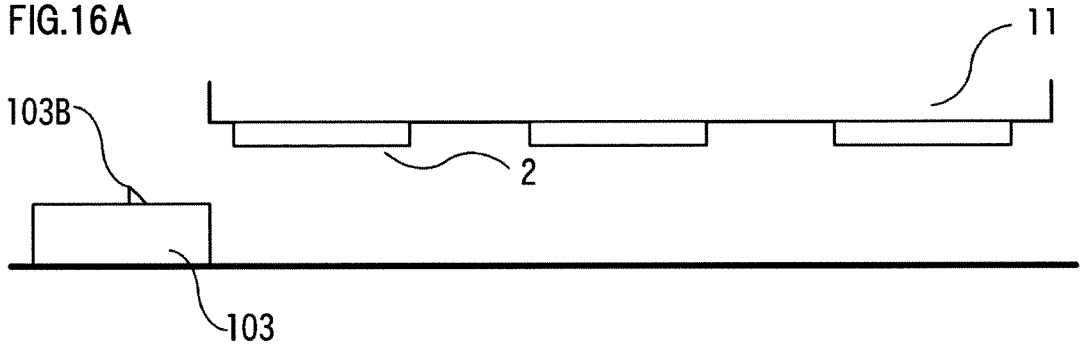
FIG. 16A is an explanatory view of wiping operation of a wiping unit.

FIG. 16A is a view showing a state where the wiping unit 103 is about to start wiping action on the inkjet heads 2 having descended from the standby position w1 or ascended from the discharge position d1. When the inkjet head holder 11 is located above the wiping unit 103 movable by drive of the motor 31, the movement of the inkjet head holder 11 stops temporarily based on a predetermined control signal, and the wiping unit 103 located in the wiping unit standby position 105*w* starts a wiping operation.

As shown, the inkjet heads 2 are arranged in a state of slightly projecting from the inkjet head holder 11. Such arrangement is taken for the purposes of positioning of each inkjet head 2 on the inkjet head holder 11, and avoiding scattering of the ink discharged to the printing paper 5 as much as possible.

Thus, the surface consisting of the lower surface of the inkjet head holder 11 and the lower surfaces of the inkjet heads 2 is not flat. On the other hand, the wiper blade 103B is constructed to contact the liquid discharge nozzle forming surfaces of the inkjet heads 2 with a predetermined pressure. Therefore, when the wiping unit 103 is moved with the wiper blade 103B located in a position for contacting the liquid discharge nozzle forming surfaces of the inkjet heads 2, the wiper blade 103B will wipe not only the lower surfaces of the inkjet heads 2 slightly projecting from the inkjet head holder 11 but the lower surface of the inkjet head holder 11 holding the inkjet heads 2. If the wiper blade 103B wipes also the lower surface of the inkjet head holder 11, the life of the wiper blade 103B will be shortened remarkably by friction with the structural material of the inkjet head holder 11.

Figure 16B:
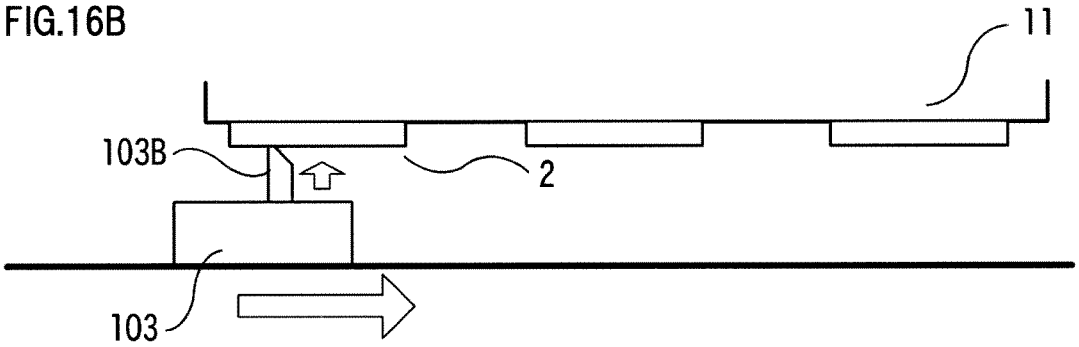
FIG. 16B is an explanatory view of wiping operation of the wiping unit.

So, as shown in FIG. 16B, the wiping unit 103 moves in the direction of arrangement of the inkjet heads 2 on the inkjet head holder 11, and when it is located under one of the inkjet heads 2, the drive motor 103*m* in response to a predetermined control signal rotates the cam shaft 103*c* to push up the wiper blade 103B. The wiper blade 103B pushed up, with movement of the wiping unit 103, wipes the one inkjet head 2.

Figure 16C:
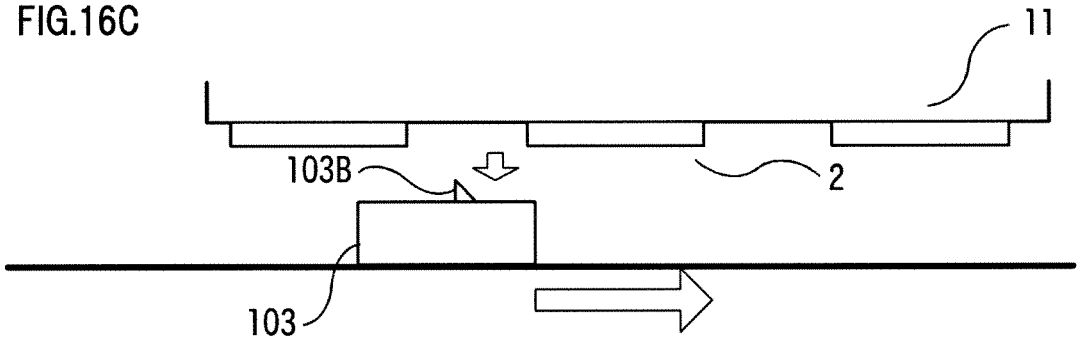
FIG. 16C is an explanatory view of wiping operation of the wiping unit.

As the wiping unit 103 continues to make further movement, as shown in FIG. 16C, the rotation of the cam shaft 103*c* by the drive motor 103*m* is stopped and the wiper blade 103B having been pushed up is lowered. In this way, the wiper blade 103B is prevented from wiping the lower surface of the inkjet head holder 11.

Figure 16D:
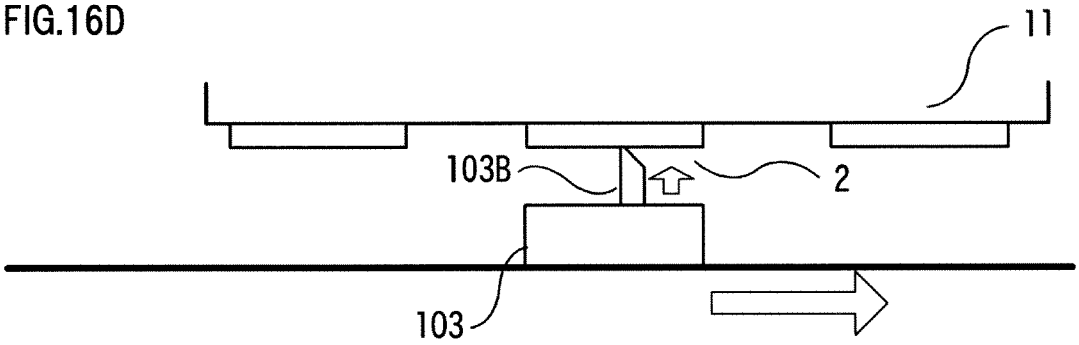
FIG. 16D is an explanatory view of wiping operation of the wiping unit.

When the wiping unit 103 moves in the direction of arrangement of the inkjet heads 2 on the inkjet head holder 11 to be located again under another inkjet head 2, as shown in FIG. 16D, the wiper blade 103B is pushed up to wipe this inkjet head 2.

Subsequently, the wiping unit 103 continues movement until all the inkjet heads 2 have been wiped. The operation shown in FIGS. 16A-16D is repeated.

Thus, while the wiping unit 103 moves in the primary scanning direction, the wiper blade 103B is moved upward only when contacting the inkjet heads 2. The wiper blade 103B will not contact the member supporting the inkjet heads 2, thereby avoiding damage to the wiper blade 103B as much as possible.

In the description of FIGS. 16A-16D, the inkjet heads 2 are wiped with the forward movement of the wiping unit 103. Alternatively, the inkjet heads 2 may be wiped with the backward movement of the wiping unit 103.

FIG. 17 is a view showing an open state of a maintenance door MD provided for the inkjet printing apparatus 100. This inkjet printing apparatus 100 has the maintenance door MD for maintaining equipment enclosed in the housing. With this construction, the printing unit 1 can be maintained by pulling the printing unit 1 out of the inkjet printing apparatus 100.

Further, with the maintenance door MD as shown, the wiping unit standby position 105*w* where the wiping unit 103 stands by is exposed even if the printing unit 1 is not pulled out. This facilitates an operation for cleaning the wiper blades 103B or an operation for changing the wiper blades 103B.

The printing paper 5 in the printing system 1000 has been described hereinbefore as the web-shaped recording medium. The object for recording by the inkjet printing apparatus 100 may be a recording medium in the form of separate sheets.

The wiping unit 103 has been described hereinbefore as having the wiper blades 103B. The wiping unit 103 may have cleaning rollers in place of the wiper blades 103B. In the case of cleaning rollers also, the drive motor 103*m* rotates the cam shaft 103*c* to push up the cleaning rollers. Thus, similarly, only the lower surface of each inkjet head 2 can be wiped.

In the description made hereinbefore, the standby position w1 of the inkjet heads 2 is in the upper portion of the printing unit 1, and the discharge position d1 in the lower portion of the printing unit 1. When the standby position w1 is located in the lower portion of the printing unit 1 and the discharge position d1 in the upper portion of the printing unit 1, the wiping unit 103 may wipe the inkjet heads 2 halfway in the upward movement of the inkjet head holder 11 holding the inkjet heads 2.

In this case also, the inkjet head holder 11 holding the inkjet heads 2 does not make an unnatural up-and-down motion for wiping purposes only. Therefore, the construction of the printing unit 1 is not complicated. Since the wiping operation by the wiping unit 103 is reliably carried out before and after discharge of the ink from the liquid discharge nozzles of the inkjet heads 2, an efficient maintenance operation is realized to render the liquid discharge nozzle forming surfaces of the plurality of inkjet heads 2 constantly clean.

Figure 18:
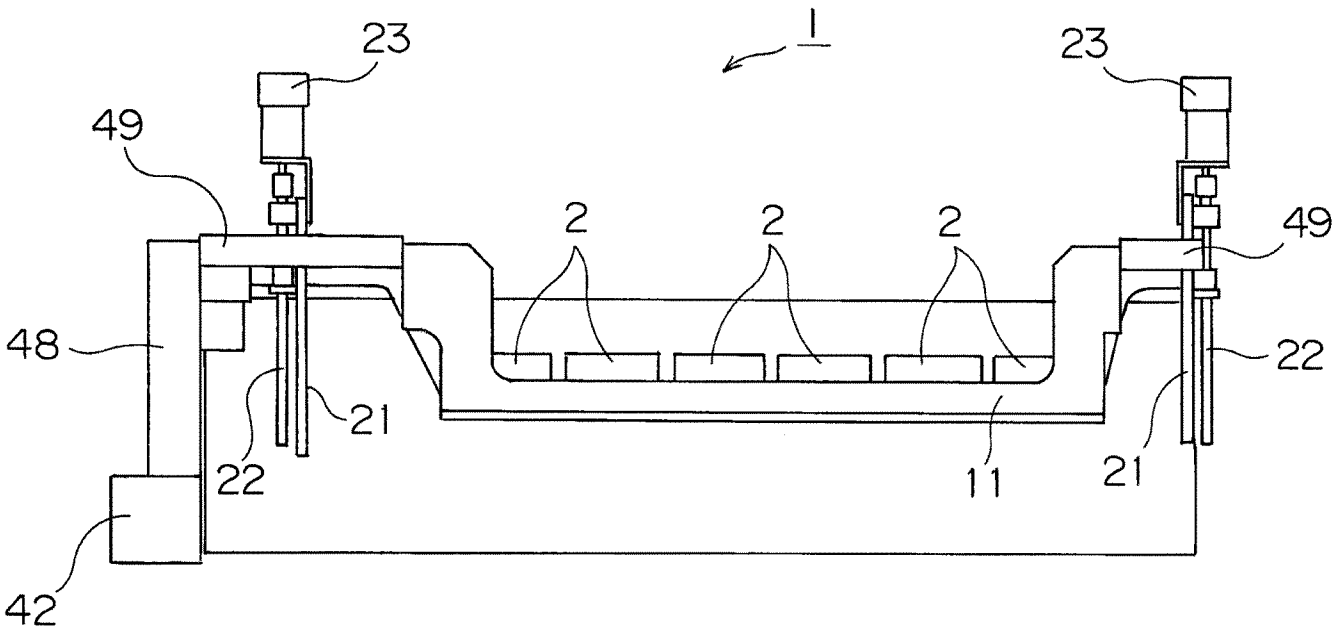
FIG. 18 is a front view of a printing unit.
Figure 19:
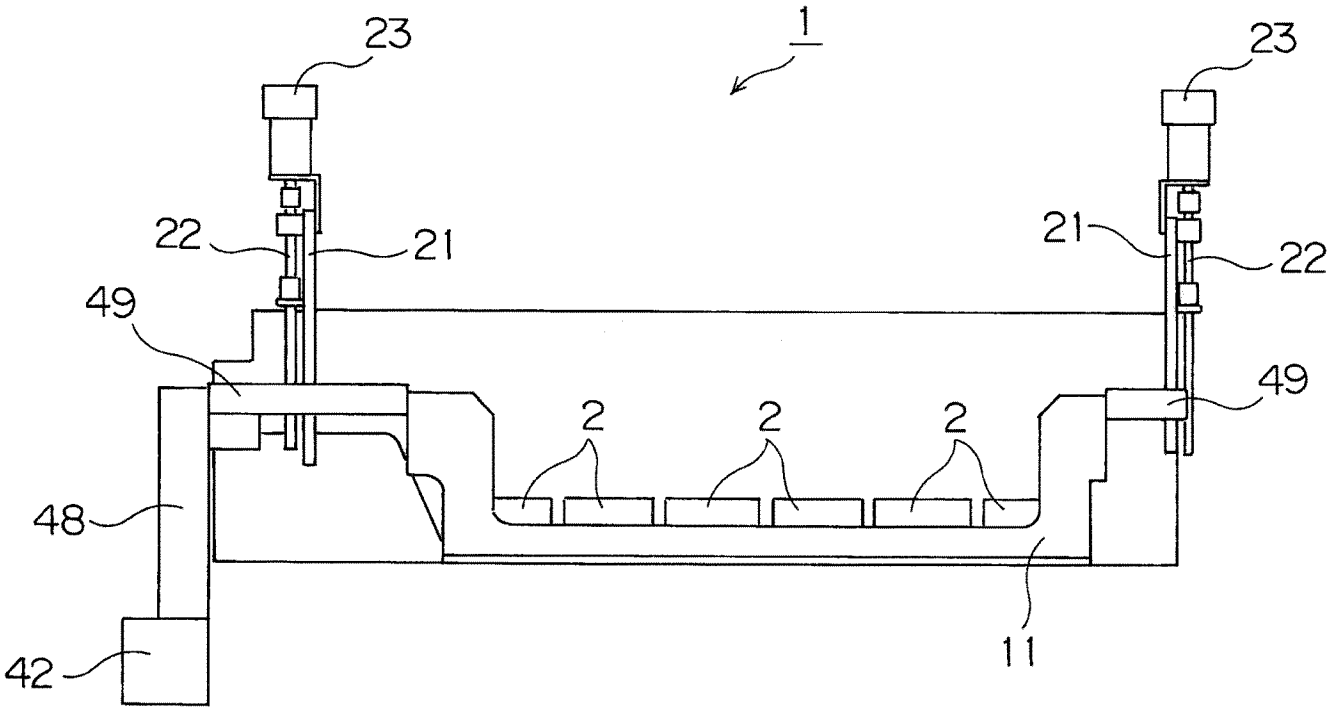
FIG. 19 is a front view of the printing unit.

Next, a construction of a printing unit 1 having a subtank 42 will be described. FIGS. 18 and 19 are front views of the printing unit 1. FIG. 18 shows a state in which an inkjet head holder 11 holding numerous inkjet heads 2 is raised. FIG. 19 shows a state in which the inkjet head holder 11 is lowered. For convenience of description, the head caps 3 and head cap holders 12 and 13 shown in FIGS. 3 through 5 are omitted from FIGS. 18 and 19.

The printing unit 1 includes numerous inkjet heads 2 and an inkjet head holder 11 holding these inkjet heads 2 en bloc. The numerous inkjet heads 2 form inkjet rows each having a plurality of inkjet heads 2 arranged end-to-end in the direction of width of printing paper 5, so that the inkjet heads 2 are arranged over a range substantially corresponding to the width of the printing paper 5 perpendicular to the moving direction of the printing paper 5. The inkjet head holder 11 holds a plurality of such inkjet rows as arranged in the moving direction of the printing paper 5. These inkjet heads 2 is constructed to penetrate the inkjet head holder 11, to be able to discharge ink from the lower surface of the inkjet head holder 11.

The inkjet head holder 11 holding the inkjet heads 2 en bloc can move up and down as guided by linear guides 21. This inkjet head holder 11 is meshed with a pair of right and left ball screws 22 through nuts not shown. The pair of ball screws 22 are rotatable by a pair of motors 23. Thus, the inkjet head holder 11 is driven by the pair of motors 23 to move up and down, and the inkjet heads 2 also move up and down therewith.

With the up-and-down movement of the inkjet head holder 11, the inkjet heads 2 move up and down, for example, between a printing position for performing printing, a cleaning position for cleaning the inkjet heads 2, and a standby position where the inkjet heads 2 are capped with head caps 3.

This printing unit 1 has the subtank 42. The subtank 42 is connected to the inkjet head holder 11 through a flange portion 49 of the inkjet head holder 11 and a connecting member 48.

Figure 20:
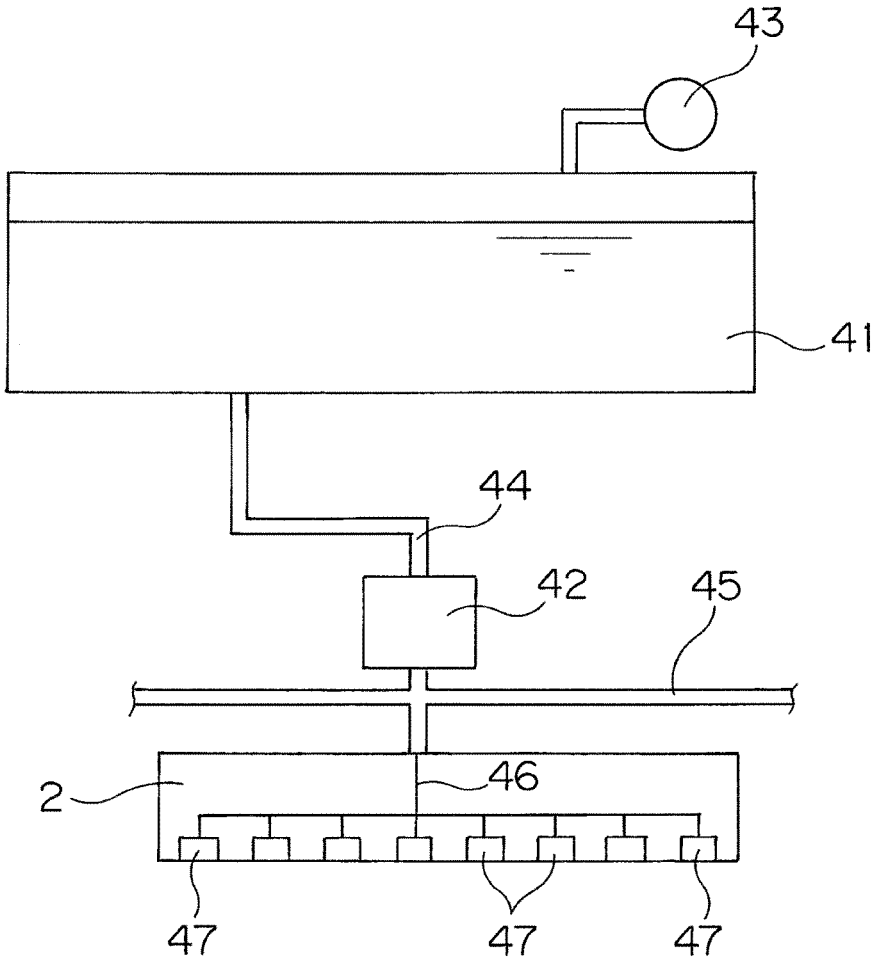
FIG. 20 is a schematic view showing a feed mechanism for feeding ink to inkjet heads.

FIG. 20 is a schematic view showing a feed mechanism for feeding ink to the inkjet heads 2.

The inkjet printing apparatus 100 according to this invention includes a main tank 41, and the subtank 42 disposed on a flow path between this main tank 41 and inkjet heads 2. The main tank 41 and subtank 42 are connected by pipeline 44. The subtank 42 and inkjet heads 2 are connected by pipeline 45.

The subtank 42 is connected to the plurality of inkjet heads 2 in the printing unit 1. In this embodiment the single subtank 42 is provided for the printing unit 1, but a plurality of such subtanks 42 may be provided. The ink supplied from the subtank 42 to each inkjet head 2 is supplied to each ink discharge portion 47 through pipeline 46 in the inkjet head 2.

The main tank 41 has an airtight structure, and a gas feed device 43 for feeding compressed air, for example, is connected to an upper portion thereof. By pressurizing the inside of the main tank 41 by action of this gas feed device 43, the ink in the main tank 41 is supplied to the subtank 42. This ink is supplied from the subtank 42 to each inkjet head 2.

In the inkjet printing apparatus 100 having the above construction, the ink is supplied through the subtank 42 to the inkjet heads 2. This subtank 42 moves up and down with the inkjet heads 2 when the inkjet heads 2 move up and down between the printing position for performing printing, the cleaning position for cleaning the inkjet heads 2, and the standby position. Therefore, the relative height position between the inkjet heads 2 and subtank 42 can always be maintained constant. This can prevent the phenomenon occurring in the prior art in which the meniscus of the ink in the inkjet heads 2 is spoiled by a difference in height between the inkjet heads 2 and subtank 42. Consequently, the ink can be discharged accurately, and printing failures such as missing nozzle can be prevented.

In the prior art, since variations occur in the relative height position between the inkjet heads 2 and subtank 42, it has been necessary to set the length of pipeline 45 connecting the inkjet heads 2 and subtank 42 according to a maximum difference in height between the inkjet heads 2 and subtank 42. Therefore, the prior art has a drawback that a pressure loss resulting from the increased length of pipeline 45 limits the number of inkjet heads 2 that can be connected to the single subtank 42. On the other hand, in the inkjet printing apparatus 100 according to this invention, since the relative height position between the inkjet heads 2 and subtank 42 is constant, the pipeline 45 may be set short to decrease the pressure loss, thereby allowing an increase in the number of inkjet heads 2 that can be connected to the single subtank 42.

In the embodiment described above, the subtank 42 and inkjet head holder 11 are connected through the connecting member 48, whereby the subtank 42 is moved up and down synchronously with the up-and-down movement of the inkjet heads 2 accompanying that of the inkjet head holder 11. However, it is possible to employ a construction in which the subtank 42 and inkjet head holder 11 are moved up and down synchronously with each other by separate lift mechanisms.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2011-17506 filed in the Japanese Patent Office on Jan. 31, 2011, Japanese Patent Application No. 2011-17507 filed in the Japanese Patent Office on Jan. 31, 2011, and Japanese Patent Application No. 2011-17490 filed in the Japanese Patent Office on Jan. 31, 2011, the entire disclosure of which is incorporated herein by reference.

What is claimed is:

1. An inkjet printing apparatus for performing printing by moving a recording medium relative to inkjet heads each with a plurality of liquid discharge nozzles, comprising:

an inkjet head holder for holding a plurality of inkjet head rows arranged in a moving direction of the recording medium, each of the inkjet head rows having the inkjet heads over a width in a transverse direction of the recording medium intersecting the moving direction of the recording medium;

a plurality of head caps corresponding to the plurality of inkjet heads held by the inkjet head holder;

a plurality of head cap holders for holding the plurality of head caps in a state corresponding to the respective inkjet heads, and as divided into a plurality of areas with respect to the moving direction of the recording medium;

a lift mechanism for moving the inkjet head holder up and down; and a head cap holder moving mechanism for arranging the plurality of head cap holders as horizontally juxtaposed in a capping position, where the respective inkjet heads and the respective head caps are opposed to each other, below the inkjet head holder when the inkjet head holder is in a raised position, and for arranging the plurality of head cap holders as vertically superposed in a withdrawn position laterally of a vertical movement area of the inkjet head holder when the inkjet head holder is in a lowered position, wherein each of the head cap holders has bearings attached to opposite ends thereof;

the head cap holder moving mechanism has guide plates having two guide grooves formed therein for engaging the bearings, each guide groove having a region for up-and-down movement and a region for horizontal movement;

the pair of bearings provided in each of the head cap holders is shifted horizontally and vertically from each other in each of the opposite ends of the head cap holders;

a connecting rod extends from one of the pair of bearings in each of the opposite ends of the head cap holders;

one of the two guide grooves has a pass-through slot penetrated by the connecting rod;

the two guide grooves are horizontally spaced from each other by a distance corresponding to an amount of horizontal shift between the pair of bearings in the vertically extending regions for up-and-down movement, and vertically spaced from each other by a distance corresponding to an amount of vertical shift between the pair of bearings in the horizontally extending regions for horizontal movement; and a drive device is connected to the connecting rod provided in one end of each of the head cap holders for moving the head cap holders along the guide grooves.

2. The inkjet printing apparatus according to claim 1, wherein the drive device includes synchronous belts each connected to the one end of each of the head cap holders, and arranged to extend along the region for up-and-down movement and the region for horizontal movement of the guide grooves.

3. The inkjet printing apparatus according to claim 1, further comprising:

a wiping unit having wiping members for wiping liquid discharge nozzle forming surfaces of the inkjet heads; and a wiping unit moving mechanism for moving the wiping unit;

wherein the lift mechanism is arranged to move the inkjet head holder up and down, thereby to move the inkjet heads between a standby position and a discharge position for causing the liquid discharge nozzles to discharge a liquid toward the recording medium; and wherein the wiping unit is arranged, when the inkjet heads are arranged in a position between the standby position and the discharge position, to be moved by the wiping unit moving mechanism to reciprocate in a direction perpendicular to the moving direction of the recording medium, thereby causing the wiping members to wipe the liquid discharge nozzle forming surfaces of the inkjet heads.

4. The inkjet printing apparatus according to claim 3, wherein the standby position is located in an upper portion of a moving range of the inkjet heads, and the discharge position is located in a lower portion of the moving range of the inkjet heads.

5. The inkjet printing apparatus according to claim 3, wherein the wiping unit includes a wiping member lift device for moving the wiping members up and down, the wiping member lift device being arranged to move the wiping members up and down when the wiping unit is moved by the wiping unit moving mechanism, thereby wiping only the liquid discharge nozzle forming surfaces of the inkjet heads.

6. The inkjet printing apparatus according to claim 3, further comprising a wiping unit standby position for keeping the wiping unit on standby, wherein the wiping unit standby position is exposed when a maintenance door provided for the inkjet printing apparatus is opened.

7. The inkjet printing apparatus according to claim 1, further comprising:

a main tank for storing ink;

a subtank disposed in an ink flow path between the main tank and the inkjet heads; and a subtank lift device for moving the subtank up and down synchronously with up-and-down movement of the inkjet heads occurring with up-and-down movement of the inkjet head holder.

8. The inkjet printing apparatus according to claim 7, wherein the subtank lift device includes a connecting member for connecting the inkjet head holder and the subtank, the connecting member causing the subtank to move up and down synchronously with the inkjet heads, thereby to move the subtank and the inkjet heads to move up and down synchronously.

* * * * *